US008622273B2

(12) United States Patent
Schneider et al.

(10) Patent No.: US 8,622,273 B2
(45) Date of Patent: Jan. 7, 2014

(54) STAPLER

(75) Inventors: Thomas Schneider, Leonberg (DE); Ulrich Schneider, Stuttgart (DE); Kurt Leute, Blumberg (DE)

(73) Assignee: Esselte Leitz GmbH & Co KG, Stuttgart (DE)

( * ) Notice: Subject to any disclaimer, the term of this patent is extended or adjusted under 35 U.S.C. 154(b) by 387 days.

(21) Appl. No.: 12/736,035

(22) PCT Filed: Feb. 16, 2009

(86) PCT No.: PCT/EP2009/051777

§ 371 (c)(1),
(2), (4) Date: Sep. 17, 2010

(87) PCT Pub. No.: WO2009/109455

PCT Pub. Date: Sep. 11, 2009

(65) Prior Publication Data

US 2011/0049213 A1 Mar. 3, 2011

(30) Foreign Application Priority Data

Mar. 4, 2008 (DE) ..... 10 2008 012 511

(51) Int. Cl.
*B25C 5/02* (2006.01)
*B25C 5/06* (2006.01)
*B25C 7/00* (2006.01)

(52) U.S. Cl.
USPC ..... 227/120; 227/119; 227/151

(58) Field of Classification Search
USPC ..... 227/175.1–182.1, 119–120, 151–152; 173/1
See application file for complete search history.

(56) References Cited

U.S. PATENT DOCUMENTS 4,040,556 A * 8/1977 Dahle ..... 227/120
4,182,474 A * 1/1980 Sato ..... 227/99
4,640,451 A * 2/1987 Steiner et al. ..... 227/76
4,773,420 A * 9/1988 Green ..... 227/178.1

(Continued)

FOREIGN PATENT DOCUMENTS

CN 2080461 7/1991
CN 1671516 9/2005

(Continued)

OTHER PUBLICATIONS

PDF Scientific and Technical Information Center (STIC) search results.*

(Continued)

*Primary Examiner* — Robert Long
(74) *Attorney, Agent, or Firm* — Collard & Roe, P.C.

(57) ABSTRACT

A stapling device includes an anvil arm bearing an anvil plate; a magazine pivotable about a transverse pivot on a bearing block in the rearward region of the anvil arm; and an arm bearing a driver for feeding the staples through a discharge slot at the front end of the magazine and pivotable about the transverse pivot. The discharge slot extends transversely through a bottom wall of the magazine between the magazine side walls which run from the front end towards the bearing block and is bounded with respect to the magazine front end by a stop plate for the staples. The discharge slot is closed with respect to the side walls of the magazine. The magazine is provided on each of its side walls and on each side of the discharge slot with a prong projecting from the bottom wall.

8 Claims, 5 Drawing Sheets

(56) References Cited

U.S. PATENT DOCUMENTS

Figure 1:
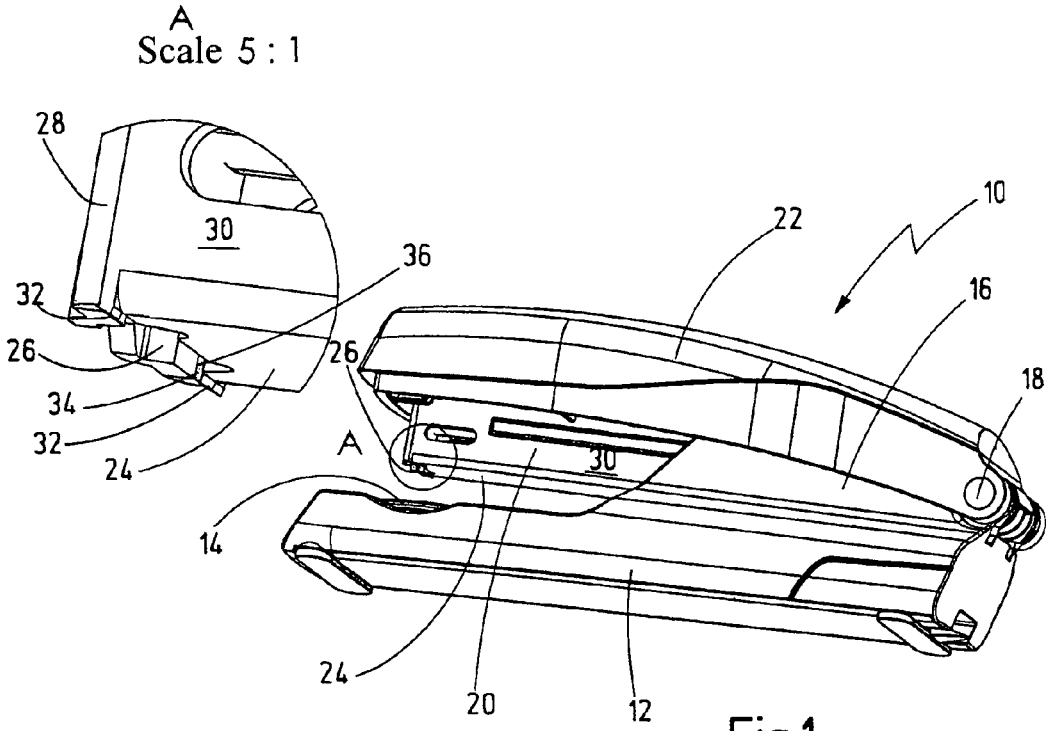

| | | | | |
|---|---|---|---|---|
| 5,292,326 | A * | 3/1994 | Green et al. | 606/143 |
| 5,389,102 | A * | 2/1995 | Green et al. | 606/143 |
| 5,423,856 | A * | 6/1995 | Green | 606/215 |
| 5,657,918 | A * | 8/1997 | Shimomura et al. | 227/7 |
| 5,692,667 | A * | 12/1997 | Chi | 227/151 |
| 6,244,491 | B1 * | 6/2001 | Kandasamy et al. | 227/134 |
| 6,722,007 | B2 * | 4/2004 | Lin | 29/268 |
| 6,913,368 | B2 * | 7/2005 | Leu | 362/119 |
| 7,021,512 | B1 * | 4/2006 | Nakamura | 227/76 |
| 7,090,110 | B2 * | 8/2006 | Adams et al. | 227/120 |
| 7,306,131 | B2 * | 12/2007 | Bargo et al. | 227/119 |
| 7,810,689 | B2 * | 10/2010 | Kumayama | 227/111 |
| 8,083,211 | B2 * | 12/2011 | Marks et al. | 254/28 |
| 8,393,516 | B2 * | 3/2013 | Kostrzewski | 227/180.1 |
| 8,523,040 | B2 * | 9/2013 | Crainich et al. | 227/175.1 |
| 2005/0167467 | A1 * | 8/2005 | Sprich | 227/151 |
| 2006/0163308 | A1 * | 7/2006 | Kitamura et al. | 227/82 |
| 2007/0145093 | A1 * | 6/2007 | Matsukawa | 227/120 |
| 2008/0156844 | A1 * | 7/2008 | Braganza et al. | 227/109 |
| 2009/0045238 | A1 * | 2/2009 | Melgaard et al. | 227/120 |
| 2010/0327042 | A1 * | 12/2010 | Amid et al. | 227/176.1 |
| 2012/0175401 | A1 * | 7/2012 | Bachman | 227/177.1 |

FOREIGN PATENT DOCUMENTS

| | | |
|---|---|---|
| DE | 10 96 862 | 1/1961 |
| EP | 1 522 388 | 4/2005 |
| GB | 641 908 | 8/1950 |

OTHER PUBLICATIONS

International Search Report.

* cited by examiner

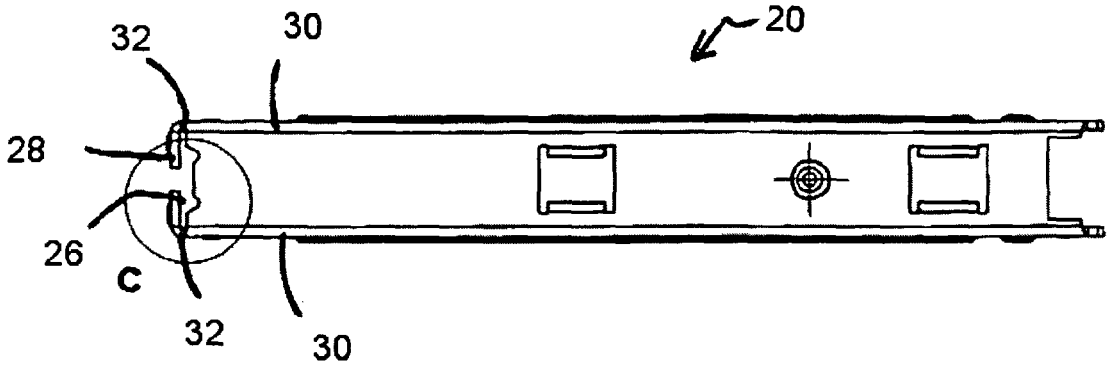
Fig. 3
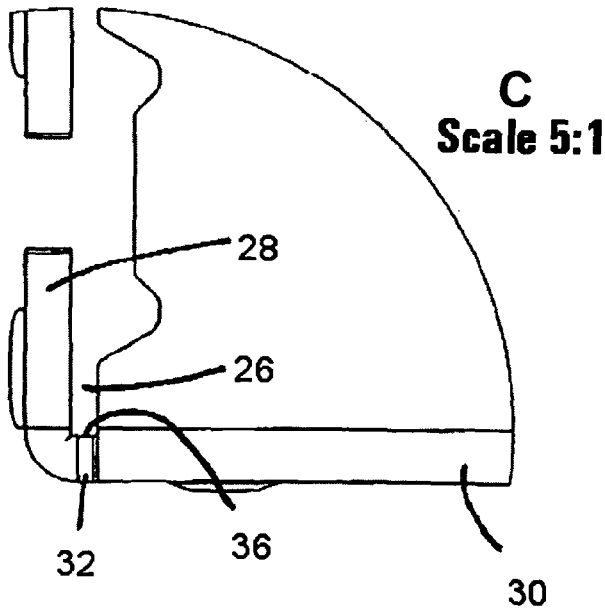

STAPLER

CROSS REFERENCE TO RELATED APPLICATIONS

This application is the National Stage of PCT/EP2009/051777 filed on Feb. 16, 2009, which claims priority under 35 U.S.C. §119 of German Application No. 10 2008 012 511.3 filed on Mar. 4, 2008, the disclosure of which is incorporated by reference. The international application under PCT article 21(2) was not published in English.

The invention relates to a stapler.

Staplers of this type serve to staple together multiple sheets of documents, using a staple. For this purpose, a staple strip composed of a plurality of staples is accommodated in the staple magazine, and this strip is pressed against the stop plate under spring support. The stop plate delimits a staple exit slot toward the front end of the staple magazine, through which the frontmost staple, in each instance, is passed by means of power applied by the driver, when the driver arm and the staple magazine are pressed down. The staple passes through the documents with its staple arms and is deformed in a deformation contour in the anvil plate. The staple exit slot extends transversely through a bottom wall of the staple magazine, and has a width, in this direction, that approximately corresponds to the width of a staple, measured from one staple arm to the other staple arm. The staple exit slot extends not only transversely over the bottom wall, but also a little farther upward, laterally through the side walls. In this region, the side walls do not form a guide for the staple arms, so that these can easily bend in an undesirable direction in the event of non-symmetrical stress or if slight deformation of the staple is already present. In particular, an unintentional movement of the document that is lying on the anvil plate during the stapling process, for example if the user is in a hurry and pulls on the document, can promote this undesirable deformation of the staple, particularly if the stapler is being held in the user's hand during the stapling process. Undesirable mis-stapling results from such staple deformations.

It is therefore the task of the invention to further develop a stapler of the type stated initially, in such a manner that the risk of mis-stapling is reduced.

This task is accomplished, according to the invention, by means of a stapler having the characteristics described herein. Advantageous further developments are also described herein.

By means of the combination of characteristics according to the invention, multiple complementary advantages are achieved at the same time. For one thing, better guidance of the staples is achieved, in that the staple exit slot is closed toward the side walls of the staple magazine. By means of this measure alone, the staple arms are guided by the side walls of the staple magazine, all the way to their lower end. Since the prongs are disposed on both sides of the staple exit slot, side guidance of the staple arms is extended somewhat further downward, toward the anvil plate. The prongs furthermore hold the document that is lying on the anvil plate in place, as soon as the staple magazine is pressed onto the document, so that it cannot slip as easily with regard to the staple exit slot.

Particularly good additional guidance by the prongs is achieved if their inner surfaces, which face one another, align with a delimitation surface that delimits the staple exit slot, in each instance. In this connection, it is preferred if the inner prong surfaces have a distance from one another that essentially corresponds to the width of a staple, measured between the outer sides of the staple arms that face away from one another. In this case, the staple arms slide along the delimitation surfaces during stapling, and are guided by them and laterally stabilized.

The prongs come to a point in the direction toward the anvil arm. They can then easily be pressed into the document to a slight extent, and hold it in place. In this connection, it is preferred that the prongs have a triangular cross-section in the direction transverse to the longitudinal sides of the staple magazine.

According to an advantageous embodiment, the staple magazine is configured as a bent part made of sheet metal, so that a stop plate of the staple magazine is formed in one piece with remaining portions of the staple magazine. It is also preferred that the prongs and the side walls, respectively, of the staple magazine together form one piece. However, it is also possible that the staple magazine has a magazine head that has the stop plate and the prongs, is connected with the side walls, and closes the staple exit slot off at the sides. The magazine head is then connected with the side walls of the staple magazine, as an additional component of the latter, for example welded onto it.

Figure 2:
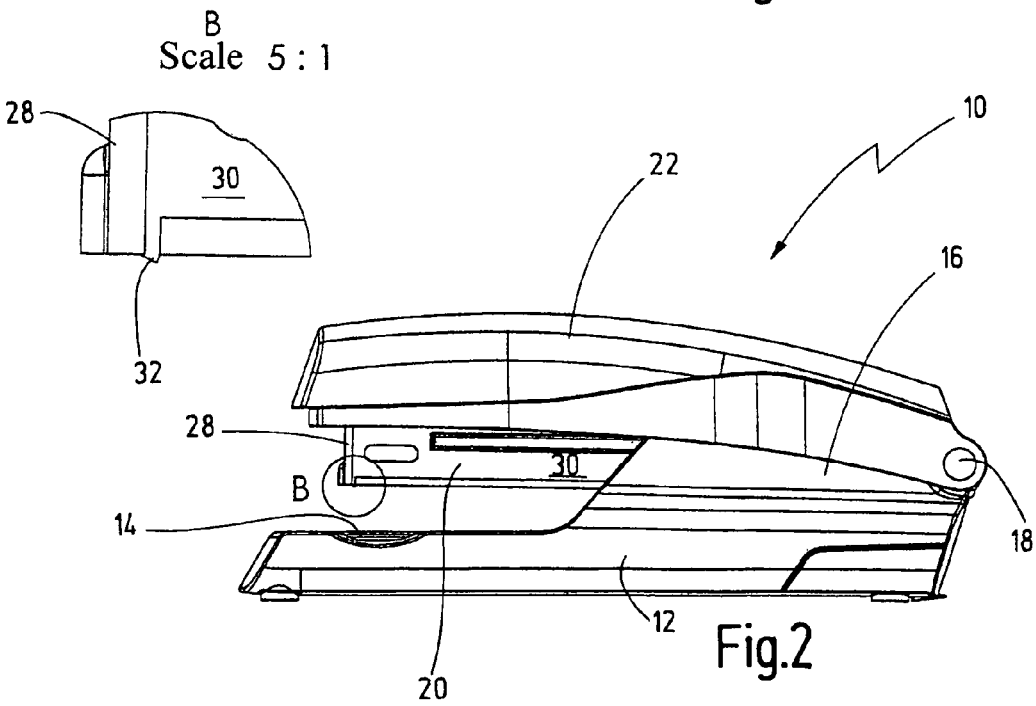
Figure 4:
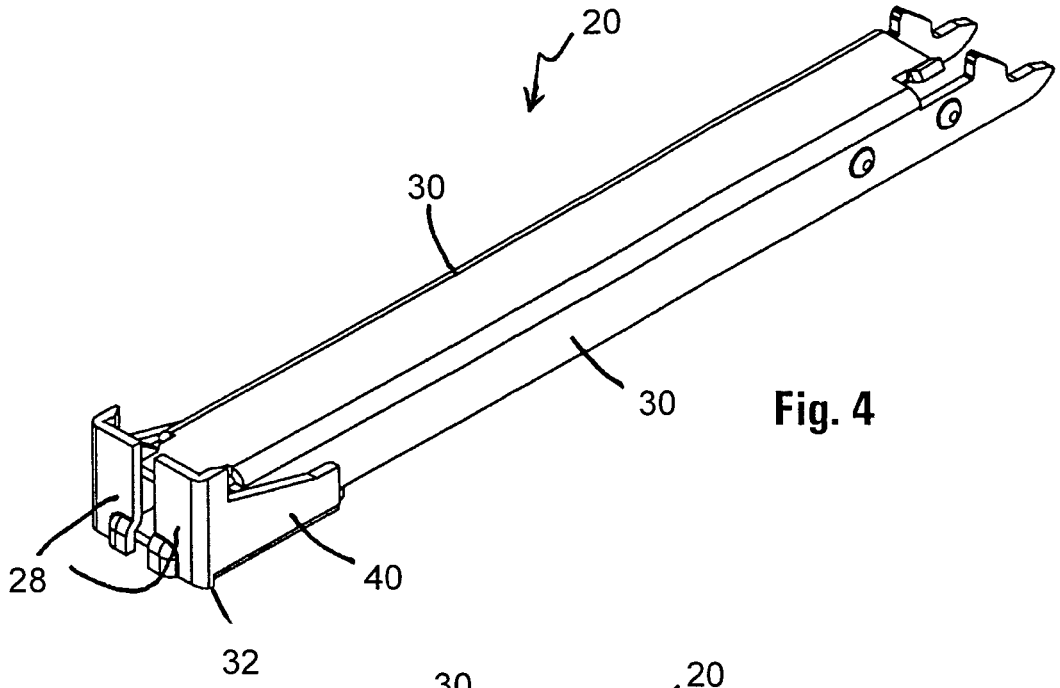
Figure 5:
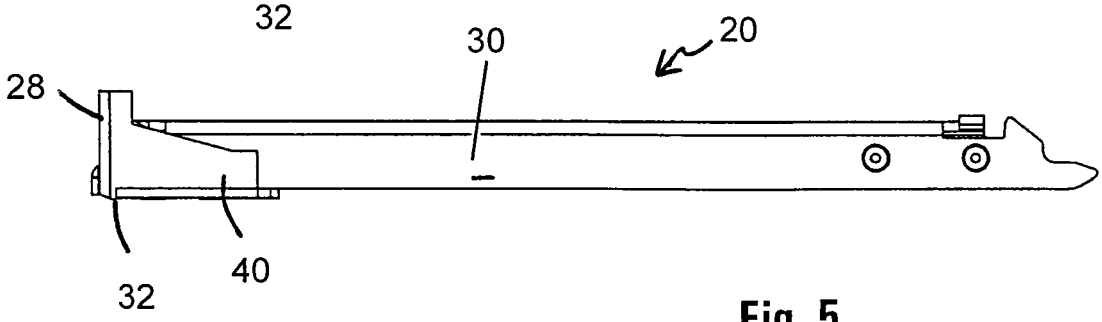
Figure 6:
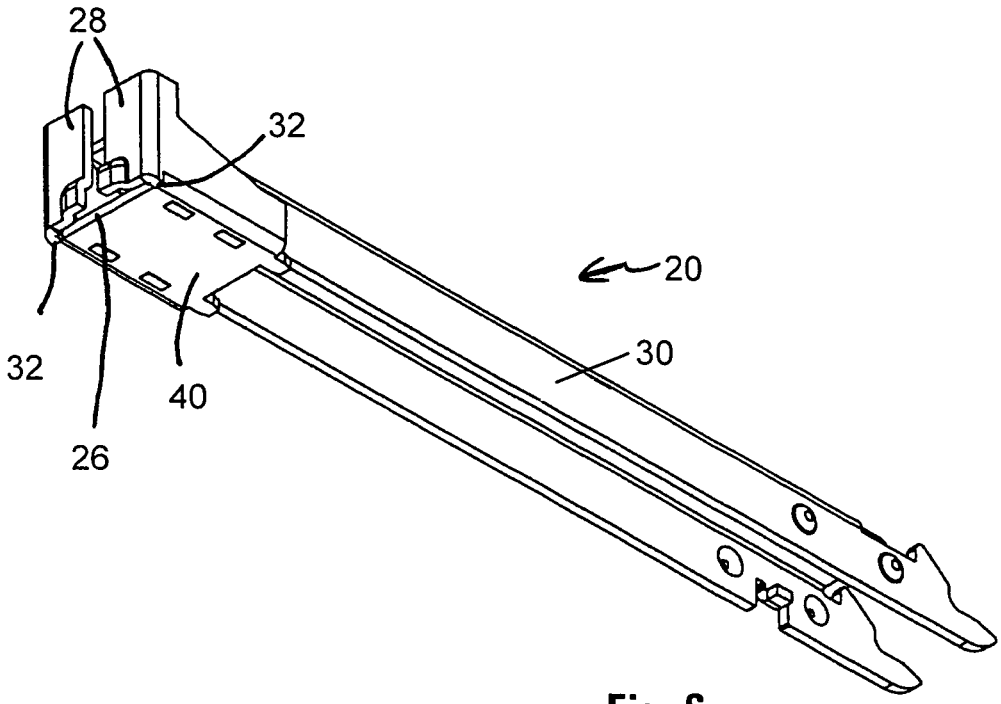
Figure 7:
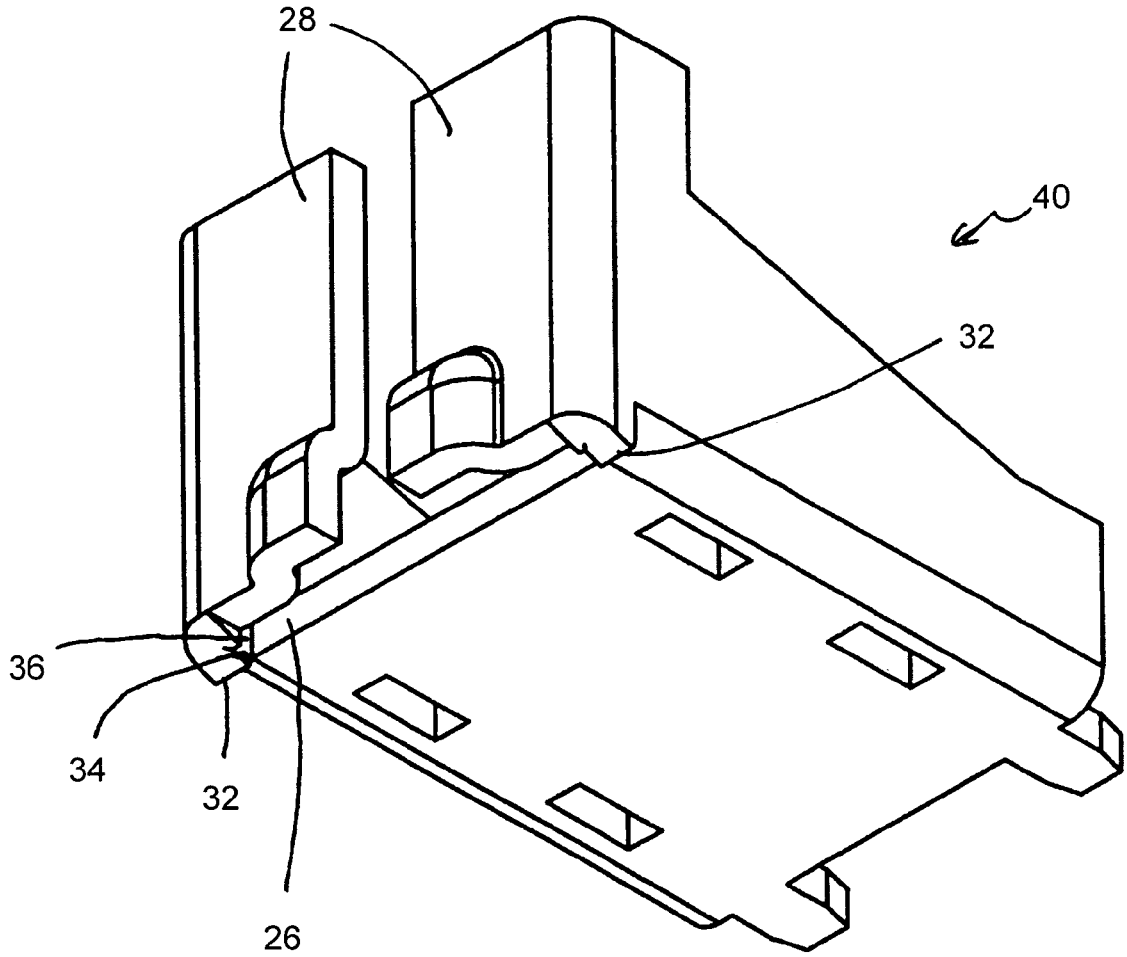

In the following, the invention will be explained in greater detail using an exemplary embodiment shown schematically in the drawing. This shows:

FIG. 1 a stapler in a perspective view, at a slant from below, with an enlarged Detail A, FIG. 2 the stapler according to FIG. 1 in a side view, with an enlarged Detail B, FIG. 3 the staple magazine of the stapler according to FIGS. 1 and 2 in a side view, with an enlarged Detail C, FIG. 4 a second embodiment of a staple magazine according to the invention in a perspective view, FIG. 5 the second embodiment of the staple magazine shown in FIG. 4 in a side view, FIG. 6 the second embodiment of the staple magazine shown in FIGS. 4 and 5 in a bottom view, and FIG. 7 a separable magazine head of the second embodiment of the staple magazine shown in FIGS. 4-6 in a perspective view.

The stapler 10 shown in the drawing has an anvil arm 12, in the front region of which an anvil plate 14 is disposed at its top. In its rear region, the anvil arm 12 has a bearing block 16, in which a transverse axis 18 is mounted, about which a staple magazine 20 can be pivoted, in limited manner, relative to the anvil arm 12. A driver arm 22 is mounted in the bearing block 16, so as to pivot about the transverse axis 18, relative to the anvil arm 12 and the staple magazine 20, and has a plastic cover that serves as a hand lever and a driver for applying force to staples accommodated in the staple magazine 20.

In order to pass through the frontmost staple, in each instance, accommodated in the staple magazine 20, by means of applying force by the driver, the staple magazine 20 has a staple exit slot 26 in its bottom wall 24. This slot is delimited, toward the front end of the staple magazine 20, by a stop plate 28 against which the frontmost staple is pressed, with spring support. On its narrow sides, the staple exit slot 26 is delimited by side walls 30 of the staple magazine 20, which extend from the front end all the way to the bearing block 16. The width of the staple exit slot 26, measured between the side walls 30, approximately corresponds to the width of the staples, measured between the outsides of their staple arms, so that the staples just fit through the staple exit slot 26. On the side walls 30, prongs 32 are formed on, in one piece, which have a triangular cross-section in a viewing direction perpendicular to the side walls 30, and come to a point at the bottom. The prongs are disposed on both sides of the staple exit slot 26, and extend slightly further downward toward the anvil arm 12. Their inside surfaces 34, which face one another, align with the delimitation surfaces 36 of the staple exit slot, so that they form an additional guide for the staples exiting from the staple exit slot 26. Furthermore, they improve the clamping effect on the documents clamped between the anvil plate 14 and the staple magazine 20 when the driver arm 22 is pressed down.

In FIGS. 4-7 an embodiment of staple magazine 20 is shown in which the staple magazine 20 has a magazine head 40 that has the stop plate 28 and the prongs 32 and is connected with the side walls 30, which head 40 closes the staple exit slot 26 off at the sides. The magazine head 40 is then connected with the side walls 30 of the staple magazine 20, as an additional component of the latter, for example is welded onto the staple magazine 20.

In summary, the following should be stated:

The invention relates to a stapler 10 having an anvil arm 12 that carries an anvil plate 14 in its front region, onto which documents can be placed, having a staple magazine 20 that can be pivoted, in limited manner, on a bearing block 16 in the rear region of the anvil arm 12, about a transverse axis 18, and having a driver arm 22 that can be pivoted, in limited manner, about the transverse axis 18, relative to the staple magazine 20 and the anvil arm 12, which carries a driver to pass the staples through a staple exit slot 26 at the front end of the staple magazine 20, whereby the staple exit slot 26 extends transversely through a bottom wall 24 of the staple magazine 20, between its side walls 30, which run from the front end in the direction toward the bearing block 16, and is delimited, toward its front end, by a stop plate 28 for the staples. According to the invention, it is provided that the staple exit slot 26 is closed toward the side walls 30 of the staple magazine 20, that the staple magazine 20 has a prong 32 projecting from the bottom wall 24, at its side walls 30, in each instance, and that the prongs 32 are disposed on both sides of the staple exit slot 26.

The invention claimed is:

1. A stapler having:

an anvil plate such that documents can be placed on the anvil plate;

an anvil arm having a rear region and a front region carrying the anvil plate;

a bearing block in the rear region of the anvil arm and having a transverse axis;

a staple magazine able to be pivoted, in limited manner, on the bearing block about the transverse axis, the staple magazine having:

a stop plate;

a magazine front end;

a bottom wall;

a first side wall running from the magazine front end toward the bearing block;

a second side wall running from the magazine front end toward the bearing block;

a staple exit slot disposed at the magazine front end, having a slot front end, extending transversely through the bottom wall and between the first and second side walls, delimited via the stop plate towards the slot front end, and closed toward the first and second side walls;

a first prong projecting from the bottom wall at the first side wall, disposed on a first side of the staple exit slot, tapered in a first direction toward the anvil arm, and forming a first guide element for staples exiting the staple exit slot; and a second prong projecting from the bottom wall at the second side wall, disposed on a second side of the staple exit slot, tapered in a second direction toward the anvil arm, and forming a second guide element for the staples exiting the staple exit slot;

a driver for passing the staples through the staple exit slot; and a driver arm able to be pivoted, in limited manner, about the transverse axis, relative to the staple magazine and the anvil arm, and carrying the driver.

2. The stapler according to claim 1, wherein the first prong has an inside surface;

wherein the second prong has an inside surface facing the inside surface of the first prong;

wherein the stapler further comprises a delimitation surface delimiting the staple exit slot;

wherein the inside surface of the first prong is aligned with the delimitation surface; and wherein the inside surface of the second prong is aligned with the delimitation surface.

3. The stapler according to claim 2, wherein a distance between the inside surface of the first prong and the inside surface of the second prong essentially corresponds to a width of a staple.

4. The stapler according to claim 1, wherein the first prong comes to a first point in a direction toward the anvil arm; and wherein the second prong comes to a second point in a direction toward the anvil arm.

5. The stapler according to claim 4, wherein the first prong has a triangular cross-section in a plane of the first side wall of the staple magazine; and wherein the second prong has a triangular cross-section in a plane of the second side wall of the staple magazine.

6. The stapler according to claim 1, wherein the staple magazine is configured as a bent part and is formed in one piece with the stop plate.

7. The stapler according to claim 1, wherein the first prong is formed with the first side wall of the staple magazine, in one piece; and wherein the second prong is formed with the second side wall of the staple magazine, in one piece.

8. The stapler according to claim 1, wherein the staple magazine further has a magazine head:

having the stop plate and the first and second prongs;

connected with the first and second side walls; and closing the staple exit slot off on the first and second sides of the staple exit slot.

* * * * *